US007265485B2

(12) United States Patent
Jung et al.

(10) Patent No.: US 7,265,485 B2
(45) Date of Patent: Sep. 4, 2007

(54) ELECTRON GUN ASSEMBLY FOR CATHODE RAY TUBE

(75) Inventors: Bong-Wook Jung, Suwon-si (KR); Deog-Ho Kim, Suwon-si (KR); Kwang-Jin Yun, Suwon-si (KR); Se-Ja-Chul Hwang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 102 days.

(21) Appl. No.: 10/958,406

(22) Filed: Oct. 6, 2004

(65) Prior Publication Data

US 2005/0218779 A1 Oct. 6, 2005

(30) Foreign Application Priority Data

Mar. 30, 2004 (KR) ..... 10-2004-0021643

(51) Int. Cl.
*H01J 29/46* (2006.01)
*H01J 29/50* (2006.01)

(52) U.S. Cl. ..... 313/456; 313/451; 313/417

(58) Field of Classification Search ..... 313/441–456, 313/409, 412, 414, 417
See application file for complete search history.

(56) References Cited

U.S. PATENT DOCUMENTS

| | | | | |
|---|---|---|---|---|
| 4,271,374 | A * | 6/1981 | Kimura | 313/449 |
| 5,894,190 | A * | 4/1999 | Hirota et al. | 313/409 |
| 6,031,326 | A * | 2/2000 | Suzuki et al. | 313/414 |
| 2002/0167260 | A1 * | 11/2002 | Oh | 313/414 |

* cited by examiner

*Primary Examiner*—Mariceli Santiago
*Assistant Examiner*—Anne M Hines
(74) *Attorney, Agent, or Firm*—Robert E. Bushnell, Esq.

(57) ABSTRACT

An electron gun assembly for a cathode ray tube includes a cathode for emitting an electron beam, and a plurality of electrodes mounted in a row with predetermined gaps therebetween. The electrodes include a focus electrode for receiving a focus voltage, and an anode electrode surrounding part of the focus electrode for receiving an anode voltage. A support is used to fix the electrodes in an aligned configuration, and a first auxiliary support secures the focus electrode to the support. The focus electrode includes an intermediate aperture section, a small aperture section, and a large aperture section, while the anode electrode includes a large aperture section and a small aperture section. Two second auxiliary supports secure the anode electrode to the support.

12 Claims, 8 Drawing Sheets

ELECTRON GUN ASSEMBLY FOR CATHODE RAY TUBE

CLAIM OF PRIORITY

This application makes reference to, incorporates the same herein, and claims all benefits accruing under 35 U.S.C. § 119 from an application for ELECTRON GUN ASSEMBLY FOR CATHODE RAY TUBE earlier filed in the Korean Intellectual Property Office on 30 Mar. 2004 and there duly assigned Serial No. 2004-0021643.

BACKGROUND OF THE INVENTION

1. Field of the Invention

The present invention relates to an electron gun assembly for a cathode ray tube (CRT), and more particularly, to an electron gun assembly for a CRT that ensures good alignment between electrodes and that is highly resistant to voltages.

2. Description of the Related Art

A projection display system that utilizes CRTs includes three CRTs for realizing red, green, and blue monochromatic display, and an optical system for enlarging each of the monochromatic images and projecting them onto a projection screen so as to combine the individual images into a single color image.

Unlike the conventional color CRTs that use three electron beams, the projection-type CRT emits a single electron beam to realize images. The image of each of the CRTs is enlarged to approximately ten times its original size before projection onto a projection screen.

Accordingly, in the projection-type CRT, a high current electron beam is used, and there is also a high electric potential between a focus electrode and a final anode electrode such that highly detailed images with a high degree of brightness are realized. Further, the focus electrode and the final anode electrode are fabricated so as to have large apertures in order to increase an aperture of a main focus lens such that greater image detail may be realized at high currents.

The electron gun assembly typically includes a cathode that emits electron beams, first through fifth electrodes for focusing and accelerating the electron beams emitted from the cathode, and a bead glass for fixedly aligning the first through fifth electrodes in a row. Auxiliary supports are fixed to each of the electrodes, and the auxiliary supports are fused to the bead glass.

The first electrode, the second electrode, and the cathode form a triode structure that controls electron emission of the cathode. The third electrode and the fifth electrode, which act as an anode electrode, receive a high anode voltage of approximately 32 kV so as to form a powerful focus lens between the third electrode and the fourth electrode. The fourth electrode, which is a focus electrode, includes a small aperture section and a large aperture section. Part of the small aperture section and all of the large aperture section are positioned within the fifth electrode to thereby increase an aperture of the main focus lens formed between the fourth electrode and the fifth electrode.

With the above electron gun assembly, precision in the formation of each electrode and good alignment of the electrodes are extremely important for realizing a high level of image detail. Since the small aperture section of the fourth electrode contacts an assembly jig during electron gun assembly, it must be precisely formed.

However, there are limits as to how precisely the cylindrical fourth electrode, and in particular, the small aperture section may be formed using present press manufacturing methods. As a result, good alignment of the electrodes during assembly is not realized, ultimately reducing picture quality. Furthermore, manufacture is made complicated by the fact that the large aperture section of the fourth electrode is positioned within the fifth electrode.

The fifth electrode includes a small aperture section and a large aperture section. The fifth electrode is fixed to the bead glass by an auxiliary support which is mounted to an outer circumference of the small aperture section and to an inner circumference of the bead glass.

With this configuration, since a maximum diameter of the combination of the small aperture section of the fourth electrode and its auxiliary support is greater than an inner diameter of the small aperture section of the fifth electrode, difficulties arise during assembly. Therefore, the fourth electrode is typically separated into two sections to perform manufacture. That is, the fourth electrode is divided into a front section and a rear section, and after the fifth electrode and the front section of the fourth electrode are mounted to the bead glass, the rear section of the fourth electrode is moved through the fifth electrode and abutted to the front section. The front section and the rear section are then welded together.

However, productivity is reduced as a result of the many steps involved in this process. Also, the alignment between the front section and the rear section of the fourth electrode is often not exact following welding of these elements. Overall alignment of the electron gun assembly is therefore negatively affected, thereby making it difficult to realize high resolution images.

In a separate issue, because of the large difference in potential between the fourth electrode and the fifth electrode, a sufficient gap must be provided between these elements so that the ability to withstand high voltages is maintained. However, a sufficient gap between the fourth electrode and the fifth electrode is not possible because of structural constraints. In particular, a sufficient gap is not possible because of the particular structure used in an effort to maximize electrode apertures (i.e., the aperture of the main focus lens) by positioning part of the fourth electrode within the fifth electrode, and the fact that this configuration is mounted within a limited aperture of a neck (the portion of the CRT in which the electron gun assembly is mounted). Hence, good voltage resistance characteristics of the conventional electron gun assembly are not realized, thereby increasing the likelihood of defects caused by voltages.

SUMMARY OF THE INVENTION

In one exemplary embodiment of the present invention, there is provided an electron gun assembly for a cathode ray tube in which precision in the formation of electrodes and alignment of the same are improved, and voltage resistance characteristics are enhanced, thereby enabling the cathode ray tube to realize good image detail and s high degree of brightness.

In an exemplary embodiment of the present invention, an electron gun assembly for a cathode ray tube includes: a cathode for emitting an electron beam; a plurality of electrodes mounted in a row with predetermined gaps therebetween, the plurality of electrodes including a focus electrode that receives a focus voltage, and an anode electrode that surrounds part of the focus electrode and receives an anode voltage; a support to which the electrodes are fixed so as to align the electrodes in a sequential configuration; and a first auxiliary support mounted to an outer circumference of the focus electrode for securing the focus electrode to the support.

The focus electrode includes an intermediate aperture section, a small aperture section, and a large aperture section formed in that sequence in a direction away from the cathode. Also, the anode electrode includes a large aperture section, and a pair of second auxiliary supports provided on an end of the large aperture section closest to the cathode, and extending in a direction toward the cathode while maintaining a distance between each other that is smaller than an inner diameter of the large aperture region. The second auxiliary supports are provided over an area of the small aperture section of the focus electrode, and are fixed to the support.

The combined width of the focus electrode and the first auxiliary support is less than the inner diameter of the large aperture section of the anode electrode.

The focus electrode and the large aperture section of the anode electrode are cylindrical.

The first auxiliary support is positioned at an outer circumference of the intermediate aperture section of the focus electrode, and the combined width of the intermediate aperture section and the first auxiliary support is less than the inner diameter of the large aperture section of the anode electrode, and is greater than the distance between the second auxiliary supports.

Each of the second auxiliary supports includes a bottom section that extends toward the inner area of the large aperture section of the anode electrode, a supporting section that extends from the bottom section toward the cathode, and a fixing section that protrudes toward the support from the supporting section so as to be fixed to the support.

The fixing section includes a pair of wing sections provided uniformly and extending in a lengthwise direction of the support, and inserting sections that are bent toward each other on distal ends of the wing sections.

The anode electrode further includes an auxiliary tab positioned between the pair of second auxiliary supports, and extending toward the cathode from an end of the large aperture section.

In another embodiment, an electron gun assembly for a cathode ray tube includes: a cathode for emitting an electron beam; a plurality of electrodes mounted in a row with predetermined gaps therebetween, the plurality of electrodes including a focus electrode that receives a focus voltage, and an anode electrode that'surrounds part of the focus electrode and receives an anode voltage; a support to which the electrodes are fixed so as to align the electrodes in a sequential configuration; and a first auxiliary support mounted to an outer circumference of the focus electrode for securing the focus electrode to the support.

The focus electrode includes an intermediate aperture section, a small aperture section, and a large aperture section formed in that sequence in a direction away from the cathode. Also, the anode electrode includes a large aperture section, a small aperture section formed on an end of the large aperture section closest to the-cathode and overlapping the smaller aperture section of the focus electrode, and having a diameter that is less than the large aperture section, and a second auxiliary support positioned at an outer circumference of the small aperture section and fixed to the support.

If the combined width of the focus electrode and the first auxiliary support is a first width, the small aperture section of the anode electrode has a large inner diameter that is greater than the first width, and a small inner diameter that is smaller than the first width.

In yet another embodiment, an electron gun assembly for a cathode ray tube includes: a cathode for emitting an electron beam; a plurality of electrodes mounted in a row with predetermined gaps therebetween, the plurality of electrodes including a focus electrode that receives a focus voltage, and an anode electrode that surrounds part of the focus electrode and receives an anode voltage; a support to which the electrodes are fixed so as to align the electrodes in a sequential configuration; and a first auxiliary support mounted at an outer circumference of the focus electrode for securing the focus electrode to the support.

The focus electrode includes an intermediate aperture section, a small aperture section, and a large aperture section formed in that sequence in a direction away from the cathode. Also, the anode electrode includes a large aperture section, a small aperture section formed on an end of the large aperture section closest to the cathode and overlapping the smaller aperture section of the focus electrode, and having a diameter that is less than the large aperture section, and a second auxiliary support positioned at an outer circumference of the small aperture section and fixed to the support.

The small aperture section of the anode electrode includes a cylindrical section having a pair of extension sections that are mounted opposing one another, the distance between the two extension sections being greater than the combined width of the focus electrode and the first auxiliary support.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Exemplary embodiments of the present invention will now be described in detail with reference to the accompanying drawings.

Figure 1:
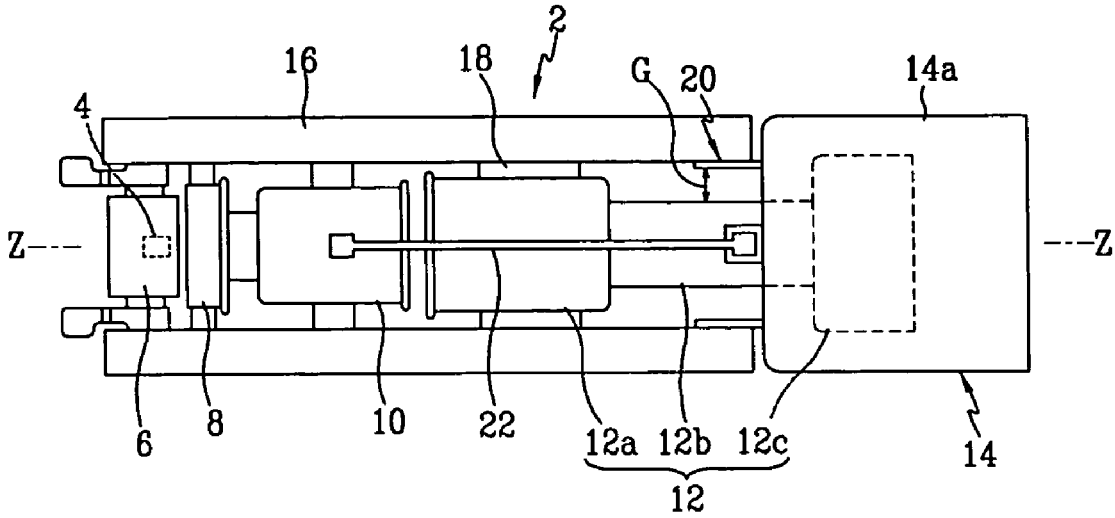
FIG. 1 is a perspective view of an electron gun assembly according to an exemplary embodiment of the present invention.
Figure 2:
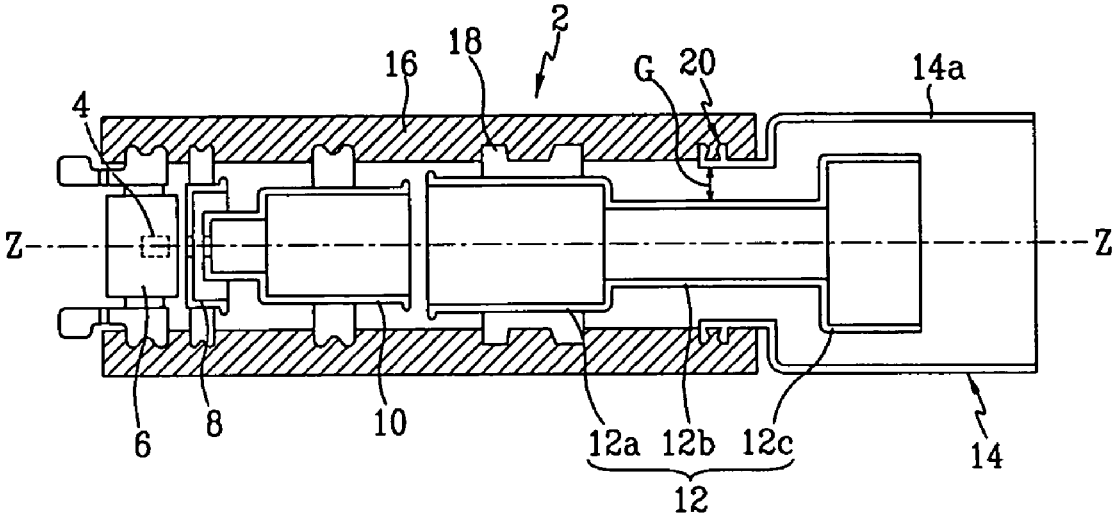
FIG. 2 is a sectional view of the electron gun assembly of FIG. 1.

FIG. 1 is a perspective view of an electron gun assembly according to an exemplary embodiment of the present invention, and FIG. 2 is a sectional view of the electron gun assembly of FIG. 1.

An electron gun assembly 2 includes a cathode 4 that emits a single electron beam. The electron gun assembly 2 also includes first through fifth electrodes 6, 8, 10, 12, and 14 mounted in a row with predetermined gaps therebetween, and acting to control the electron beam emitted from the cathode 4. The first through fifth electrodes 6, 8, 10, 12, and 14 are mounted in an aligned configuration (in that sequence) on a bead glass 16.

An auxiliary support is provided for each of the first through fifth electrodes 6, 8, 10, 12, and 14, the auxiliary supports being fused to the bead glass 16. As an example, reference numeral 18 indicates a first auxiliary support for fixing the fourth electrode 12 to the bead glass 16. Also, reference numeral 20 indicates a second auxiliary support used to fix the fifth electrode 14 to the bead glass 16.

The first electrode 6 and the second electrode 8 form a triode structure with the cathode 4 so as to control electron emission of the cathode 4. As an example of the operation of the triode structure, a drive voltage that is lower than a voltage applied to the cathode 4 is applied to the first electrode 6, and a drive voltage that is higher than the voltage applied to the cathode 4 is applied to the second electrode 8 so as to realize preliminary focusing of the electron beam emitted from the cathode 4.

The third electrode 10 is electrically connected to the fifth electrode 14 through a connector 22 such that a high anode voltage of approximately 32 kV is applied to both the third and fifth electrodes 10 and 14, respectively. The fourth electrode 12 receives a focusing voltage of 10-20 kV. As a result, the third electrode 10 acts as a first anode electrode, the fourth electrode 12 acts as a focus electrode, and the fifth electrode 14 acts as a second anode electrode. The resulting lens operation of the third, fourth, and fifth electrodes 10, 12, and 14, respectively, functions to perform final focusing and acceleration of the electron beam emitted from the cathode 4.

A velocity modulation (VM) coil (not shown) may be provided on an outer circumference of a neck of the CRT, inside of which the electron gun assembly 2 is mounted, at a location corresponding to the positioning of the fourth electrode 12. The fourth electrode 12 may be divided into a plurality of separate electrode to improve VM sensitivity. These separate electrodes are electrically connected and, therefore, do not form an electron beam lens. The instance where the fourth electrode 12 forms a single cylindrical electrode is now described.

Figure 3:
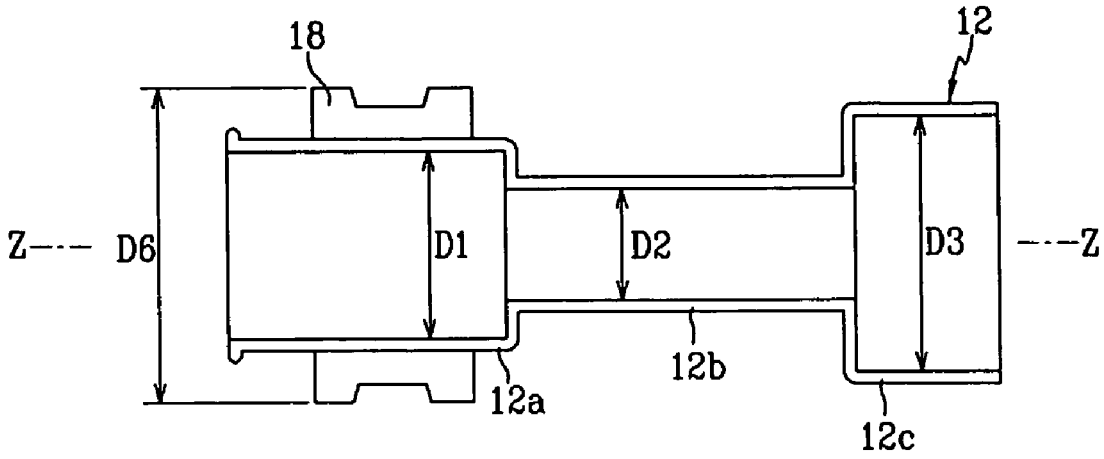
FIG. 3 is an enlarged view of a fourth electrode shown in FIG. 2.

FIG. 3 is an enlarged view of the fourth electrode 12. The fourth electrode 12 of this exemplary embodiment provides for improved precision in its formation and improved alignment, and is also sufficiently distanced from the fifth electrode 14 to thereby improve voltage resistance characteristics.

The fourth electrode 12 includes an intermediate aperture section 12*a*, a small aperture section 12*b*, and a large aperture section 12*c*. Center axes of the intermediate, small, and large aperture sections 12*a*, 12*b*, and 12*c*, respectively, substantially coincide with a center longitudinal axis of the CRT. The center axes are indicated by Z-Z in the drawings. The intermediate, small, and large aperture sections 12*a*, 12*b*, and 12*c*, respectively, have predetermined lengths, as well as predetermined diameters D1, D2, and D3, respectively. These diameters D1, D2, and D3 satisfy the following inequality:

$$D2<D1<D3.$$

The first auxiliary support 18 is connected to an outer circumference of the intermediate aperture section 12*a* to thereby fix the fourth electrode 12 to the bead glass 16. The small aperture section 12*b* is used by an assembly jig (not shown) to align the fourth electrode 12 during mounting of the first through fifth electrodes 6, 8, 10, 12, and 14 to the bead glass 16. Further, the large aperture section 12*c* is positioned within the fifth electrode 14 so as to form a main focus lens of a maximum aperture with the fifth electrode 14.

The small aperture section 12*b* of the fourth electrode 12 structured as set forth above has a smaller length in the fourth electrode 12 than in conventional electron gun assemblies. Therefore, when manufacturing the fourth electrode 12 using press processes that include the utilization of a mold, more precise fabrication of the fourth electrode 12, and in particular, of the small aperture section 12*b* of the fourth electrode 12, may be realized. Ultimately, the alignment of the fourth electrode 12 using an assembly jig, which connects to the small aperture section 12*b* as described above, is improved.

Since the difference in potential between the fourth electrode 12 and the fifth electrode 14 is large during operation of the electron gun assembly 2, it is necessary that a predetermined distance between these elements be maintained. The electron gun assembly 2 is structured such that the fifth electrode 14 is closest to the fourth electrode 12 in the area where the second auxiliary supports 20 are connected to the bead glass 16. In this exemplary embodiment, the small aperture section 12*b* of the fourth electrode 12 is mounted in opposition to the area where the second auxiliary support 20 is mounted to the bead glass 16 such that there is a sufficient gap G between the fourth electrode 12 and the auxiliary support 20 of the fifth electrode 14.

With the application of the electron gun assembly 2 of the exemplary embodiment to a CRT, the effect of improving voltage resistance may be described by the Equation (1) below, which is well known in the art. That is, if it is assumed that a powerful electrical field is applied to two parallel electrodes in a high vacuum state, and an electron beam is emitted from a cathode, the amount of current generated between the two electrodes may be expressed by the following equation:

$$J=1.54_S\,10^{-6}E^2/\Phi \qquad \text{[Equation 1]}$$

where $$E=\frac{\beta V}{d},$$

$J(V/cm^2)$ is the current density, E(V/cm) is the electrical field applied to the electrodes, Φ(V) is the work function of the electrodes β is a constant with respect to electrode formation, V(V) is a potential difference between the two electrodes, and d(cm) is the distance between the two electrodes.

The current generated between the two electrodes is a current that is unwanted in the CRT, and is referred to as leakage current. In the case of a projection-type CRT, which uses relatively high voltages, the maximum voltage difference V between the fourth electrode 12 and the fifth electrode 14 is 30 kV, and the work function Φ used in the electron gun assembly is 4-5 eV. Therefore, the distance d between the electrodes must be 1.5 mm or greater so as to ensure that almost no leakage current is generated under normal conditions.

However, in practice and even when the CRT is operating normally, there is a leakage current of 0.05 μA or less between the two electrodes. If any projections from the electrodes are formed or a surface state thereof is altered, the constant β with respect to the formation of the electrodes becomes sufficiently large so that an electrical field is generated in these areas. Therefore, the overall electric field E increases so that leakage current is generated. If the distance d between the electrodes is sufficiently large, the surface state of the electrodes becomes identical such that the electrical field applied to the electrodes is reduced, thereby reducing the amount of leakage current to a sufficiently low level.

In the electron gun assembly of the exemplary embodiment, the distance between the fourth electrode 12 and the fifth electrode 14 is made sufficiently large by the configuration used for the fourth electrode 12. Voltage resistance characteristics are improved as a result. This is because, for identical conditions of the material used for the electrodes, surface state and applied voltage, the leakage current between the two electrodes is inversely proportional to a factor of the distance between the same.

Figure 4:
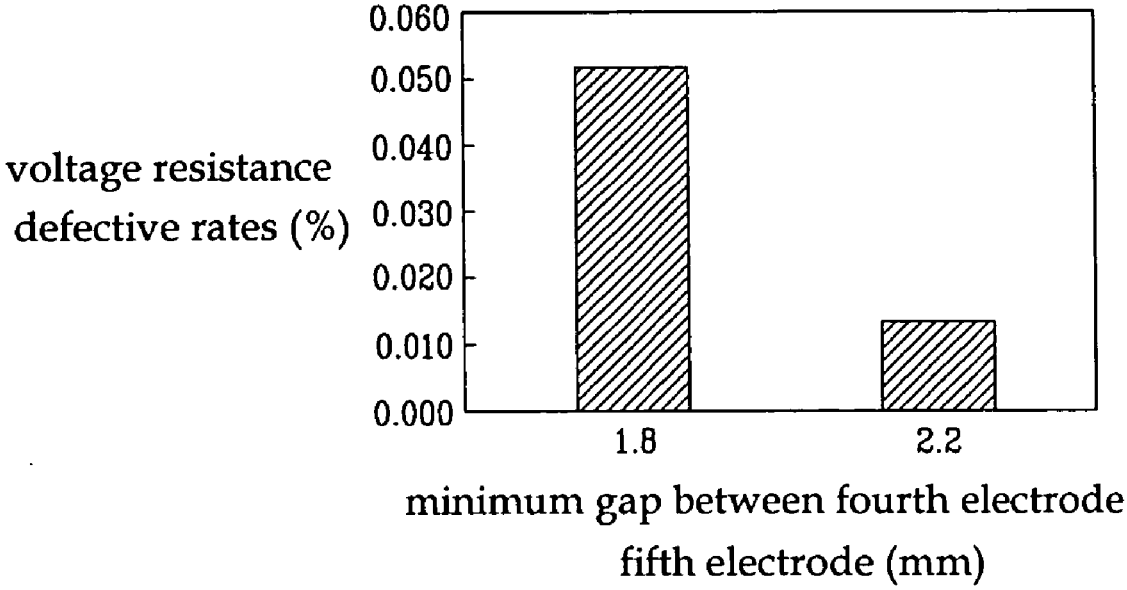
FIG. 4 is a graph of voltage resistance defective rates of an electron gun assembly as a function of a gap between a fourth electrode and a fifth electrode.

FIG. 4 is a graph of voltage resistance defective rates of the electron gun assembly 2 as a function of the gap between the fourth electrode 12 and the fifth electrode 14. Examples is where the minimum gap between the fourth electrode 12 and the fifth electrode 14 are 1.8 mm and 2.2 mm are provided. The electron gun assembly 2 is considered to be defective when the leakage current is 5 μA or greater.

It is evident from the graph that, for identical conditions of the material used for the electrodes, surface state and applied voltage, there is a significant decrease in the voltage resistance defective rate with an increase in the distance between the fourth and fifth electrodes 12 and 14 from 1.8 mm to 2.2 mm.

In the electron gun assembly 2 of this exemplary embodiment, the fifth electrode 14 is configured as described below to overcome assembly problems of the fourth electrode. In particular, the fifth electrode 14 is structured such that the first auxiliary support 18 fixed to the intermediate aperture section 12*a* of the fourth electrode 12 is able to pass through the fifth electrode 14. This allows the fourth electrode 12 to be manufactured as an integral unit, and not as separate units that require assembly after being positioned within the neck of the CRT.

Figure 5:
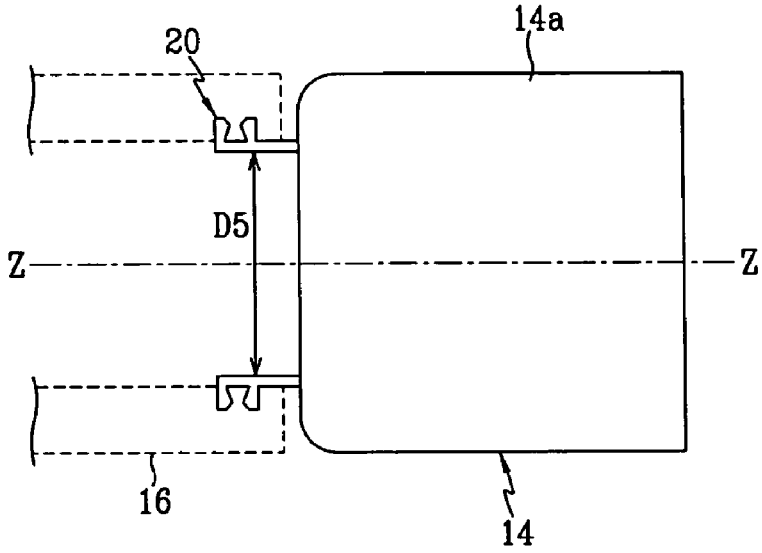
FIG. 5 is an enlarged view of a fifth electrode shown in FIG. 2.
Figure 6:
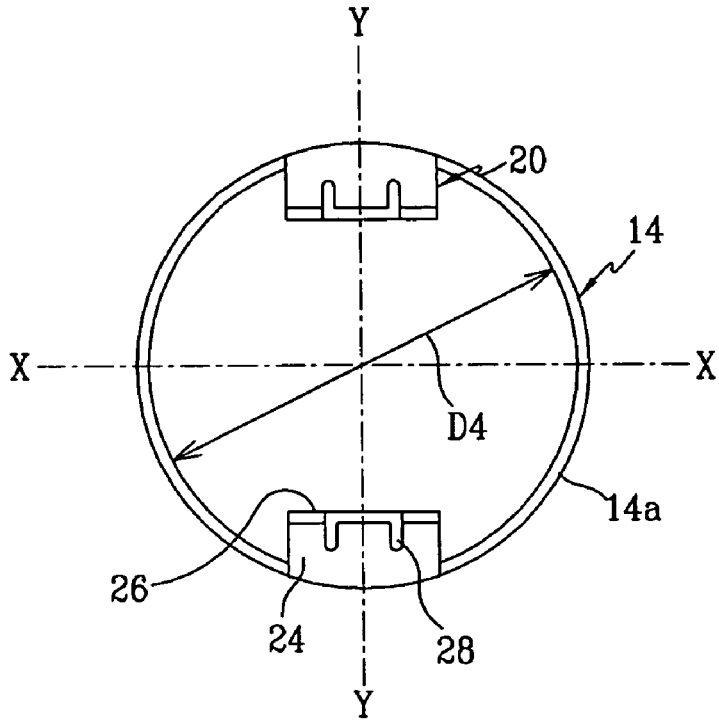
FIG. 6 is a side view of a fifth electrode shown in FIG. 2.

FIG. 5 is an enlarged view of the fifth electrode 14, and FIG. 6 is a side view of the fifth electrode 14. The fifth electrode 14 includes a large aperture section 14*a* that surrounds part of the fourth electrode 12, and a pair of second auxiliary supports 20 provided on an end (hereinafter referred to as the "support end") of the large aperture section 14*a* closest to the cathode 4.

The second auxiliary supports 20 are provided on the support end of the large aperture section 14*a* at a predetermined distance D5 from each other. The distance D5 is smaller than an inner diameter D4 of the large aperture section 14*a* of the fifth electrode 14. Each of the second auxiliary supports 20 includes a base section 24 that extends toward the inner area of the large aperture section 14*a*, a supporting section 26 that extends from the base section 24 in the axial direction of the CRT (direction Z-Z), and fixing elements 28 that protrude toward the bead glass 16 from the supporting section 26 for fusion welding to the bead glass 16.

The fifth electrode 14 structured as described above includes the second auxiliary supports 20 instead of the configuration using a small aperture section. Therefore, the combined width D6 of the intermediate aperture section 12*a* of the fourth electrode 12 and the first auxiliary support 18 (see FIG. 3) is greater than the distance D5 between the second auxiliary supports 20 positioned on the support end of the fifth electrode 14 (see FIG. 5), but is smaller than the inner diameter D4 of the large aperture section 14*a* of the fifth electrode 14 (see FIG. 6).

As a result, if the fourth electrode 12 is slightly rotated so that the first auxiliary support 18 of the fourth electrode 12 and the second auxiliary supports 20 of the fifth electrode 14 do not collide, the entire fourth electrode 12 is able to easily pass through the interior of the fifth electrode 14 in the CRT axial direction (the Z-Z direction).

Accordingly, in this exemplary embodiment of the present invention, the structure of the fifth electrode 14 is such that the fourth electrode 12 may be made as an integral unit and not as separate units as described above. Therefore, alignment problems encountered when the fourth electrode 12 is made as separate elements requiring assembly after being positioned within the neck of the CRT are avoided.

Figure 7:
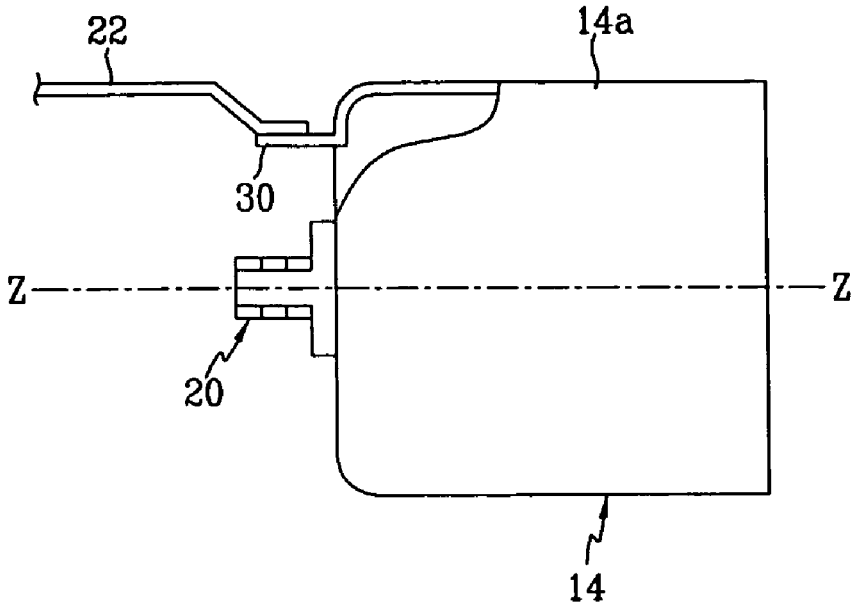
FIG. 7 is a front view of a fifth electrode shown in FIG. 1.

The electron gun assembly 2 further includes an auxiliary tab 30 for fixing of the connector 22 to the fifth electrode 14, as shown in FIG. 7, which is a front view of the fifth electrode 14.

The auxiliary tab 30 is positioned between the pair of second auxiliary supports 20 at the support end of the perimeter of the large aperture section 14*a* of the fifth electrode 14, and extends toward the cathode 4 from an inner area of the large aperture section 14*a*. As a result, the connector 22 is fixed to the third electrode 10 and the fifth electrode 14 so as to electrically interconnect these two elements. This allows easy welding of the connector 22 to the fifth electrode 14.

Figure 8:
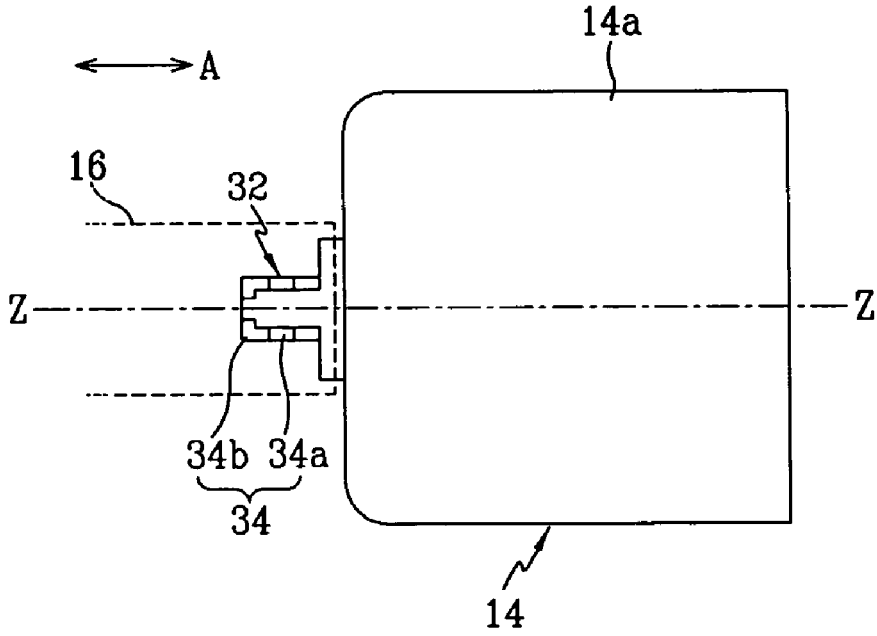
FIG. 8 is a front view of a fifth electrode according to another exemplary embodiment of the present invention.
Figure 9:
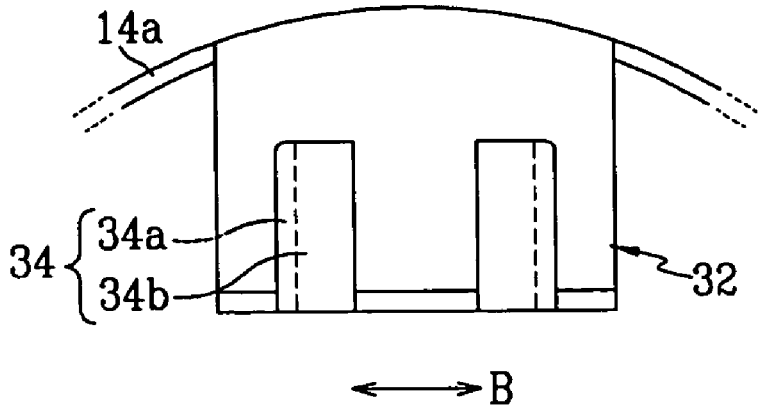
FIG. 9 is a side view of a second auxiliary support of FIG. 8.

A structure as described below is used to increase the support strength of the fifth electrode 14 on the second auxiliary supports 20. FIG. 8 is a front view of a fifth electrode according to another exemplary embodiment of the present invention, and FIG. 9 is a side view of a second auxiliary support of FIG. 8.

A fixing section 34 of a second auxiliary support 32 includes two wing sections 34*a* provided opposing one another and extending in a lengthwise direction of a bead glass 16 (direction A in FIG. 8), and inserting sections 34*b* which are bent substantially at right angles toward each other on distal ends of the wing sections 34*a*. As a result, when the fixing section 34 of the second auxiliary support 32 is fused to the bead glass 16, the inserting sections 34*b* are positioned in the direction of a width of the bead glass 16

(direction B in FIG. 9) such that the support strength of the fifth electrode 14 in this direction is enhanced.

Additional exemplary embodiments of the fifth electrode are described below.

Figure 10:
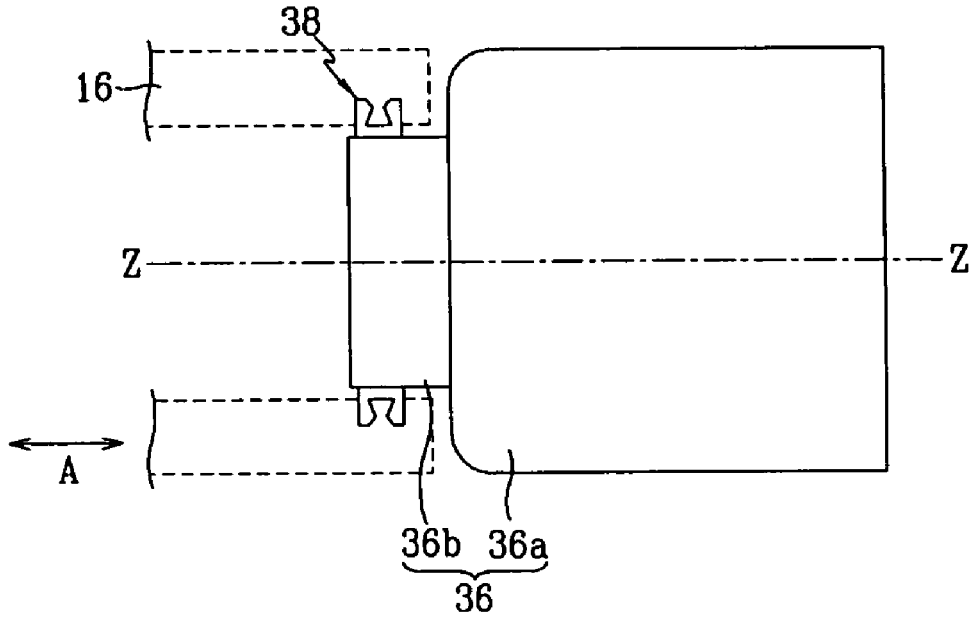
FIG. 10 is a plan view of a fifth electrode according to yet another exemplary embodiment of the present invention.
Figure 11:
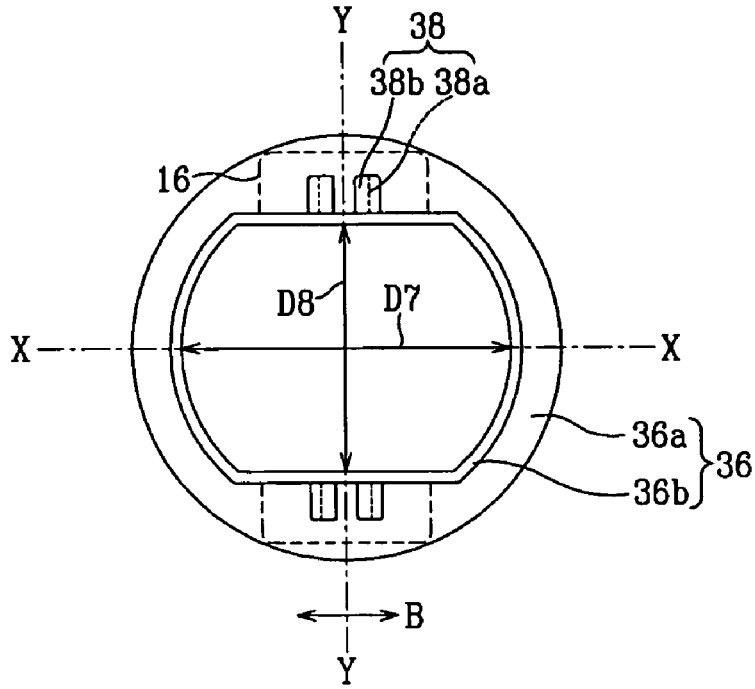
FIG. 11 is a side view of the fifth electrode of FIG. 10.

FIG. 10 is a plan view of a fifth electrode according to yet another exemplary embodiment of the present invention, and FIG. 11 is a side view of the fifth electrode of FIG. 10. A fifth electrode 36 includes a large aperture section 36*a* that is cylindrical, and a small aperture section 36*b* that is formed on that end of the large aperture section 36*a* closest to the cathode 4 (see FIG. 1).

The small aperture section 36*b* has a cross section that is rectangular or elliptical, or a shape that combines rectangular and elliptical forms. In either case, the small aperture section 36*b* has a short inner diameter D7 (minor axis when elliptical) and a long inner diameter D8 (major axis when elliptical). The combined cross-sectional distance of the short inner diameter D7 and the first auxiliary support 18 is greater than the width D6 (see FIG. 3) of the intermediate section 12*a* of the fourth electrode 12, and the long inner diameter D8 is smaller than the width D6 of the intermediate section 12*a* of the fourth electrode.

Therefore, if the fourth electrode 12 is rotated approximately 90 degrees so that the first auxiliary support 18 of the fourth electrode 12 and the small aperture section 36*b* of the fifth electrode 36 do not collide, the entire fourth electrode 12 is able to easily pass through the inside of the fifth electrode 14 in the CRT axial direction (direction Z-Z).

Each of the second auxiliary supports 38 mounted on an outer circumference of the small aperture section 36*b* includes a pair of wing sections 38*a* positioned uniformly along the lengthwise direction of the bead glass 16 (direction A in FIG. 10), and inserting sections 38*b* that are bent toward the wing sections 38*a* at distal ends of the wing sections 38*a* so as to be positioned in the direction of the width of the bead glass 16 (direction B in FIG. 11).

Figure 12:
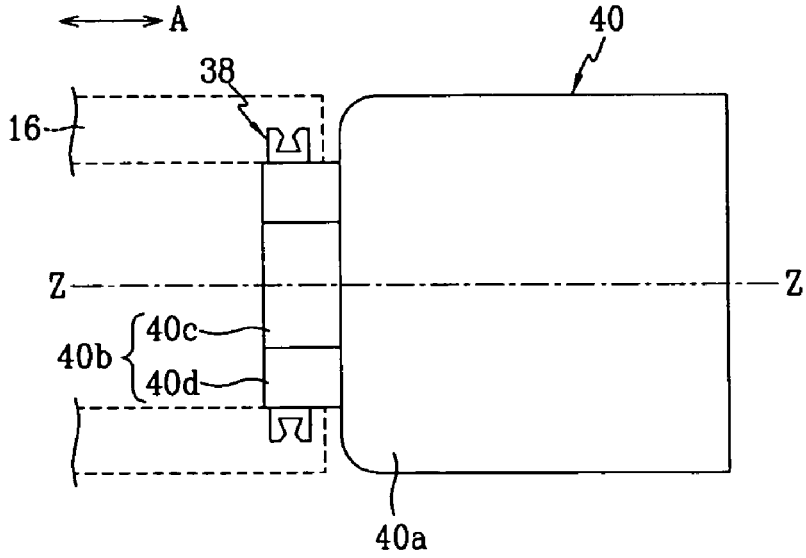
FIG. 12 is a plan view of a fifth electrode according to still yet another exemplary embodiment of the present invention.
Figure 13:
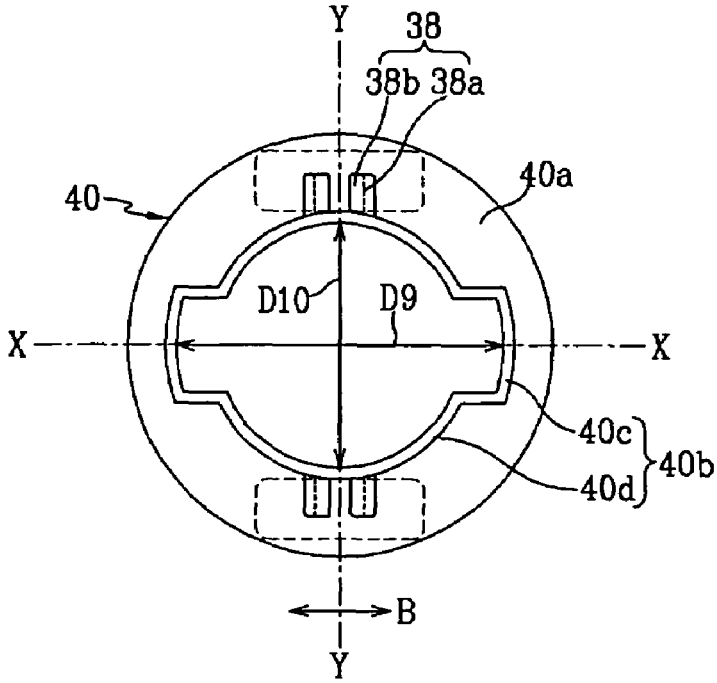
FIG. 13 is a side view of the fifth electrode of FIG. 12.

FIG. 12 is a plan view of a fifth electrode according to still yet another exemplary embodiment of the present invention, and FIG. 13 is a side view of the fifth electrode of FIG. 12.

A fifth electrode 40 includes a large aperture section 40*a* and a small aperture section 40*b*. The small aperture section 40*b* includes a cylindrical section 40*d* having a pair of extension sections 40*c* that are mounted in opposition to one another. The combined length of a distance D9 between the two extension sections 40*c* and an outer circumference of the first auxiliary support 18 is less than the width D6 (FIG. 3) of the intermediate aperture section 12*a* of the fourth electrode 12.

Therefore, if the fourth electrode 12 is rotated approximately 90 degrees so that the first auxiliary support 18 of the fourth electrode 12 and the cylindrical section 40*d* of the fifth electrode 40 do not collide, the entire fourth electrode 12 is able to easily pass into the fifth electrode 14 in the CRT axial direction (direction Z-Z) through the large aperture section 40*a* and the extension sections 40*c* of the small aperture section 40*b*.

Each of the second auxiliary supports 38 mounted on an outer circumference of the cylindrical section 40*d* of the small aperture section 40*b* includes a pair of wing sections 38*a* positioned uniformly in the lengthwise direction of the bead glass 16 (direction A in FIG. 10), and inserting sections 38*b* that are bent toward the other wing sections 38*a* at distal ends of the wing sections 38*a* so as to be positioned in the direction of the width of the bead glass 16 (direction B in FIG. 11).

Figure 14:
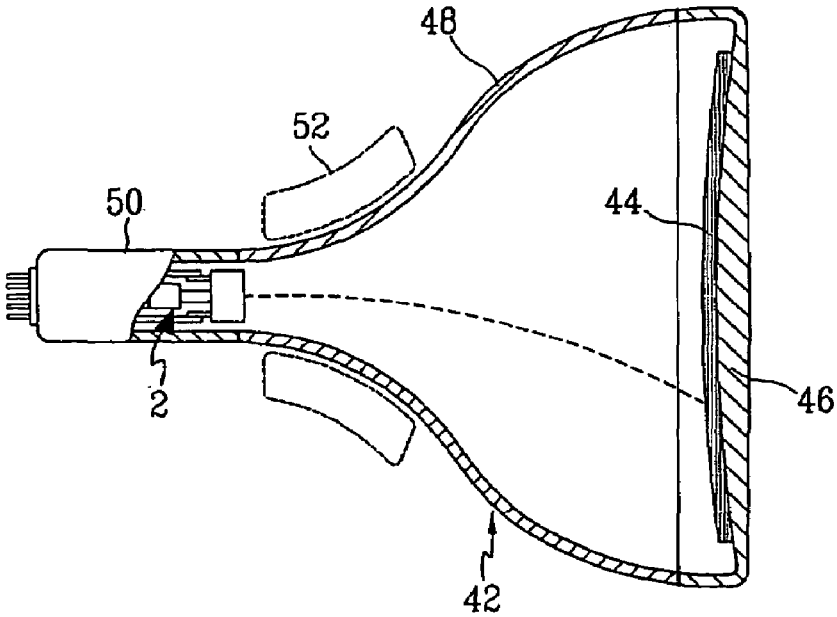
FIG. 14 is a partial sectional view of a projection-type cathode ray tube to which an electron gun assembly of the present invention is applied.
Figure 15:
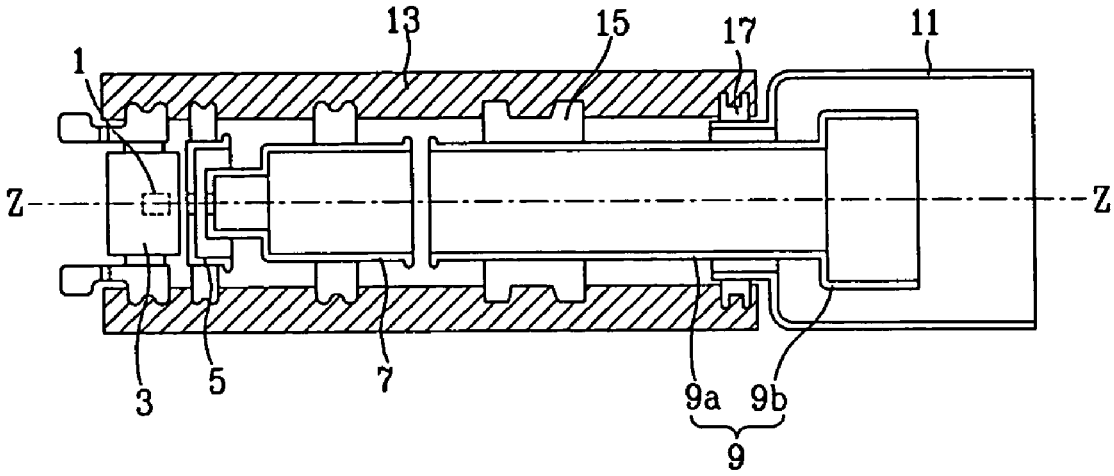
FIG. 15 is a sectional view of a conventional electron gun assembly used in a projection-type CRT.
Figure 16:
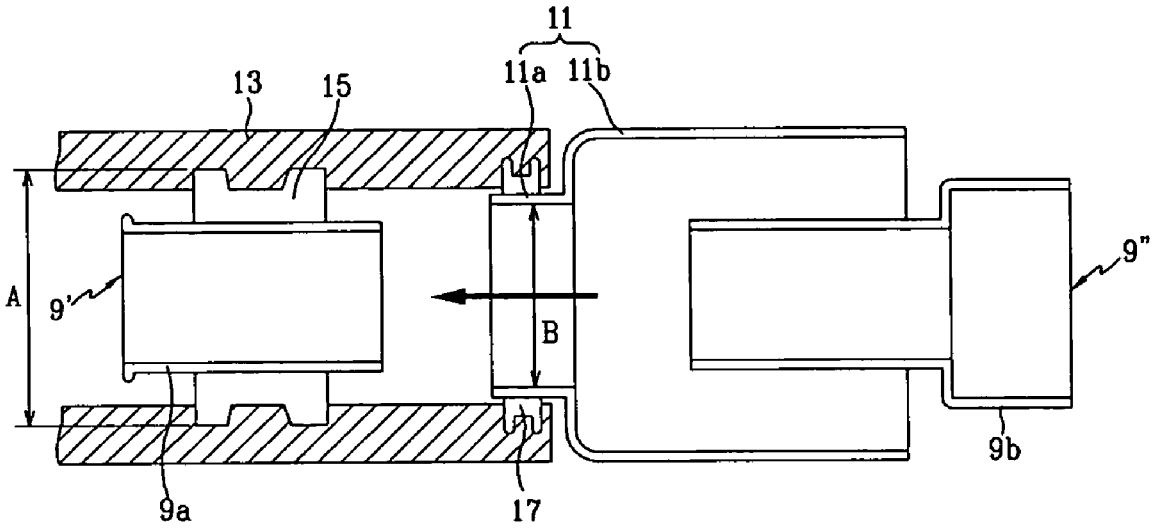
FIG. 16 is an enlarged sectional view of the conventional electron gun assembly shown in FIG. 15.

FIG. 14 is a partial sectional view of a CRT to which the electron gun assembly 2 of the present invention is applied. A projection-type CRT is provided in which a single electron beam is emitted from the electron gun assembly 2 to realize the display of an image.

A CRT 42 includes a panel 46 along an inner surface of which is formed a phosphor screen 44. The electron gun assembly 2 is mounted in a neck 50, and a funnel 48 is provided between the panel 46 and the neck 50. The electron gun assembly 2 emits an electron beam toward the phosphor screen 44 of the panel 46. A deflection yoke 52 is mounted on an outer circumference of the funnel 48 for generating a deflecting magnetic field to control scanning of the electron beam on the phosphor screen 44.

In the projection-type CRT 42, the phosphor screen 44 provides for only a single color, that is, one of red, green, and blue. Therefore, a projection display system includes three projection-type CRTs for realizing red, green, and blue monochromatic images, respectively, and an optical system for enlarging and projecting each of the monochromatic images onto a projection screen so as to combine the individual images into a single color image.

Although embodiments of the present invention have been described in detail hereinabove in connection with certain exemplary embodiments, it should be understood that the invention is not limited to the disclosed exemplary embodiments but, on the contrary, is intended to cover various modifications and/or equivalent arrangements included within the spirit and scope of the present invention, as defined in the appended claims.

What is claimed is:

1. An electron gun assembly for a cathode ray tube, comprising:

a cathode for emitting an electron beam;

a plurality of electrodes mounted in a row with predetermined gaps therebetween, the plurality of electrodes including a focus electrode which receives a focus voltage, and an anode electrode which surrounds a part of the focus electrode and receives an anode voltage;

a support to which the electrodes are fixed so as to align the electrodes in a sequential configuration; and a first auxiliary support mounted on an outer circumference of the focus electrode for securing the focus electrode to the support;

wherein the focus electrode includes an intermediate aperture section, a small aperture section, and a large aperture section formed sequentially in a direction away from the cathode, a diameter difference between the intermediate aperture section and the small aperture section being greater than a thickness of the focus electrode;

wherein the anode electrode includes a large aperture section and a pair of second auxiliary supports provided on an end of the large aperture section of the anode electrode closest to the cathode and extending in a direction toward the cathode while maintaining a distance between each other that is smaller than the inner diameter of the large aperture section; and wherein a combined width of the focus electrode and the first auxiliary support is less than an inner diameter of the large aperture section of the anode electrode;

wherein each second auxiliary support comprises a bottom section that extends toward an inner area of the large aperture section of the anode electrode, a supporting section that extends from the bottom section toward the cathode, and a fixing section that protrudes from the supporting section so as to be fixed to the support; and wherein the fixing section comprises a pair of wing sections provided uniformly and extending in a lengthwise direction of the support, and inserting sections that are bent toward each other on distal ends of the wing sections.

2. The electron gun assembly of claim 1, wherein the first auxiliary support is positioned on an outer circumference of the intermediate aperture section of the focus electrode, and a combined width of the intermediate aperture section and the first auxiliary support is less than the inner diameter of the large aperture section of the anode electrode, and is greater than the distance between the second auxiliary supports.

3. The electron gun assembly of claim 1, wherein the focus electrode and the large aperture section of the anode electrode are cylindrical.

4. An electron gun assembly for a cathode ray tube, comprising:

a cathode for emitting an electron beam;

a plurality of electrodes mounted in a row with predetermined gaps therebetween, the plurality of electrodes including a focus electrode which receives a focus voltage, and an anode electrode which surrounds a part of the focus electrode and receives an anode voltage;

a support to which the electrodes are fixed so as to align the electrodes in a sequential configuration; and a first auxiliary support mounted on an outer circumference of the focus electrode for securing the focus electrode to the support;

wherein the focus electrode includes an intermediate aperture section, a small aperture section, and a large aperture section formed sequentially in a direction away from the cathode, a diameter difference between the intermediate aperture section and the small aperture section being greater than a thickness of the focus electrode;

wherein the anode electrode includes a large aperture section and a small aperture section formed on an end of the large aperture section of the anode electrode, and wherein, when a combined width of the focus electrode and the first auxiliary support is a first width, the small aperture section of the anode electrode has a large inner diameter which is greater than the first width, and a small inner diameter which is smaller than the first width; and wherein the small aperture section of the anode electrode is formed on the end of the large aperture section of the anode electrode closest to the cathode and overlapping the small aperture section of the focus electrode, and has a diameter which is less than a diameter of the large aperture section of the anode electrode, and the anode electrode further comprises a second auxiliary support positioned on an outer circumference of the small aperture section of the anode electrode and fixed to the support.

5. The electron gun assembly of claim 4, wherein the second auxiliary support comprises a pair of wing sections provided uniformly and extending in a lengthwise direction of the support, and inserting sections which are bent toward each other on distal ends of the wing sections.

6. The electron gun assembly of claim 4, wherein the focus electrode and the large aperture section of the anode electrode are cylindrical.

7. The electron gun assembly of claim 4, wherein the first auxiliary support is positioned on an outer circumference of the intermediate aperture section of the focus electrode.

8. An electron gun assembly for a cathode ray tube, comprising:

a cathode for emitting an electron beam;

a plurality of electrodes mounted in a row with predetermined gaps therebetween, the plurality of electrodes including a focus electrode which receives a focus voltage, and an anode electrode which surrounds a part of the focus electrode and receives an anode voltage;

a support to which the electrodes are fixed so as to align the electrodes in a sequential configuration; and a first auxiliary support mounted on an outer circumference of the focus electrode for securing the focus electrode to the support;

wherein the focus electrode includes an intermediate aperture section, a small aperture section, and a large aperture section formed sequentially in a direction away from the cathode, a diameter difference between the intermediate aperture section and the small aperture section being greater than a thickness of the focus electrode; and wherein the anode electrode includes a large aperture section and a small aperture section formed on an end of the large aperture section of the anode electrode, and wherein the small aperture section of the anode electrode includes a cylindrical section having a pair of extension sections which are mounted in opposition to one another, a distance between the two extension sections being greater than a combined width of the focus electrode and the first auxiliary support.

9. The electron gun assembly of claim 8, wherein the small aperture section of the anode electrode is formed on the end of the large aperture section of the anode electrode closest to the cathode and overlapping the small aperture section of the focus electrode, and has a diameter which is less than a diameter of the large aperture section, and the anode electrode further comprises a second auxiliary support positioned on an outer circumference of the small aperture section and fixed to the support.

10. The electron gun assembly of claim 9, wherein the second auxiliary support comprises a pair of wing sections provided uniformly and extending in a lengthwise direction of the support, and inserting sections which are bent toward each other on distal ends of the wing sections.

11. The electron gun assembly of claim 8, wherein the focus electrode and the large aperture section of the anode electrode are cylindrical.

12. The electron gun assembly of claim 8, wherein the first auxiliary support is positioned on an outer circumference of the intermediate aperture section of the focus electrode.

* * * * *